US005758990A

United States Patent [19]

Davies et al.

[11] Patent Number: 5,758,990

[45] Date of Patent: Jun. 2, 1998

[54] RISER TENSIONING DEVICE

[75] Inventors: Richard Davies, Irvine, Calif.; Lyle D. Finn, Sugar Land, Tex.; Roger Pokladnik, Houston, Tex.; Robert George Schoenberg, Katy, Tex.

[73] Assignee: Deep Oil Technology, Incorporated, Houston, Tex.

[21] Appl. No.: 804,046

[22] Filed: Feb. 21, 1997

[51] Int. Cl.[6] ..... E21B 7/12; E21B 17/01

[52] U.S. Cl. ..... 405/242.2; 166/350; 405/242.4

[58] Field of Search ..... 166/350, 367; 405/224.4, 224.2, 195.1

[56] References Cited

U.S. PATENT DOCUMENTS 3,981,357 9/1976 Walker et al. ..... 405/224.2 X
4,176,986 12/1979 Taft et al. ..... 166/350 X
4,702,321 10/1987 Horton ..... 166/350

FOREIGN PATENT DOCUMENTS 1519203 7/1978 United Kingdom ..... 166/367

*Primary Examiner*—David J. Bagnell
*Attorney, Agent, or Firm*—Robert J. Edwards; D. Neil LaHaye

[57] ABSTRACT

A riser tensioning device that utilizes parallel air cans. A stem having an inner diameter larger than the outer diameter of the riser is positioned around the riser and is fastened in position at the wellhead of the riser on the offshore structure. A yoke attached to the stem supports a number of sleeves around the stem. Each sleeve receives a variable buoyancy air can. The sleeves and air cans are provided with a retainer that retains the air cans in the sleeves and transfers the vertical loads of the air cans to the sleeve. The retainer is also designed to allow the air cans to be selectively removed from their individual sleeves without the need to pull the entire riser assembly.

6 Claims, 3 Drawing Sheets

RISER TENSIONING DEVICE

BACKGROUND OF THE INVENTION

1 . Field of the Invention

The invention is generally related to risers for floating offshore oil and gas production structures and more particularly to a tensioning device for the risers.

2 . General Background

In the production of oil and gas at offshore locations, it is necessary to support the risers used in production and drilling operations. Air can tensioning devices are commonly used to provide such support. The air cans use buoyant forces to support and over tension the risers which extend from the structure down to the sea floor.

The contemporary design for air can riser tensioning devices utilizes large outer diameter (o.d.) steel cans. Generally, the can has a large o.d. outer shell and a small o.d. inner shell and is closed at the top. The riser string passes through the inner shell of the can. In operation, the can is underwater and water is displaced by air in the annular area between the inner and outer shells. This causes the can to become buoyant and the buoyancy forces are transferred to the riser pipe for support and over tensioning. Large buoyancy requirements are achieved by connecting air cans end to end in a series fashion. This is referred to as a series design air can system. Series design air cans have several disadvantages.

From time to time, air cans need to be replaced or repaired. Repair or replacement of series design air cans requires that the riser be retrieved and laid down before the air can is pulled. Retrieving the riser interrupts operations and can be very costly.

Manufacturing the series design air cans generally requires rolling large o.d. cylinders out of steel plate and connecting these cylinders to smaller o.d. cylinders which form the inside wall of the can. Because of the large o.d.'s these cans have, they are usually stiffened on the inside to prevent buckling of the outer shell during transport.

Transport of the series design air can requires special packing and cribbing to prevent damage to the outer shell.

Installation can also present limitations. For a spar structure, as described in U.S. Pat. No. 4,702,321, series design cans must be installed offshore only after the structure has been up ended into its operational position because the series design cans are difficult to control during the up ending procedure.

The air supply and control piping can become very complicated for series design air cans and present the potential for many possible leak paths which are not possible to repair without retrieving the air can.

SUMMARY OF THE INVENTION

The invention addresses the above disadvantages of the present state of the art. What is provided is a riser tensioning device that utilizes parallel air cans instead of series air cans. A stem having an inner diameter larger than the outer diameter of the riser is positioned around the riser and is fastened in position at the wellhead of the riser on the offshore structure. A yoke attached to the stem supports a number of sleeves around the stem. Each sleeve receives a variable buoyancy air can. The sleeves and air cans are provided with a retainer that retains the air cans in the sleeves and transfers the vertical loads of the air cans to the sleeve. The retainer is also designed to allow the air cans to be selectively removed from their individual sleeves without the need to pull the entire riser assembly.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
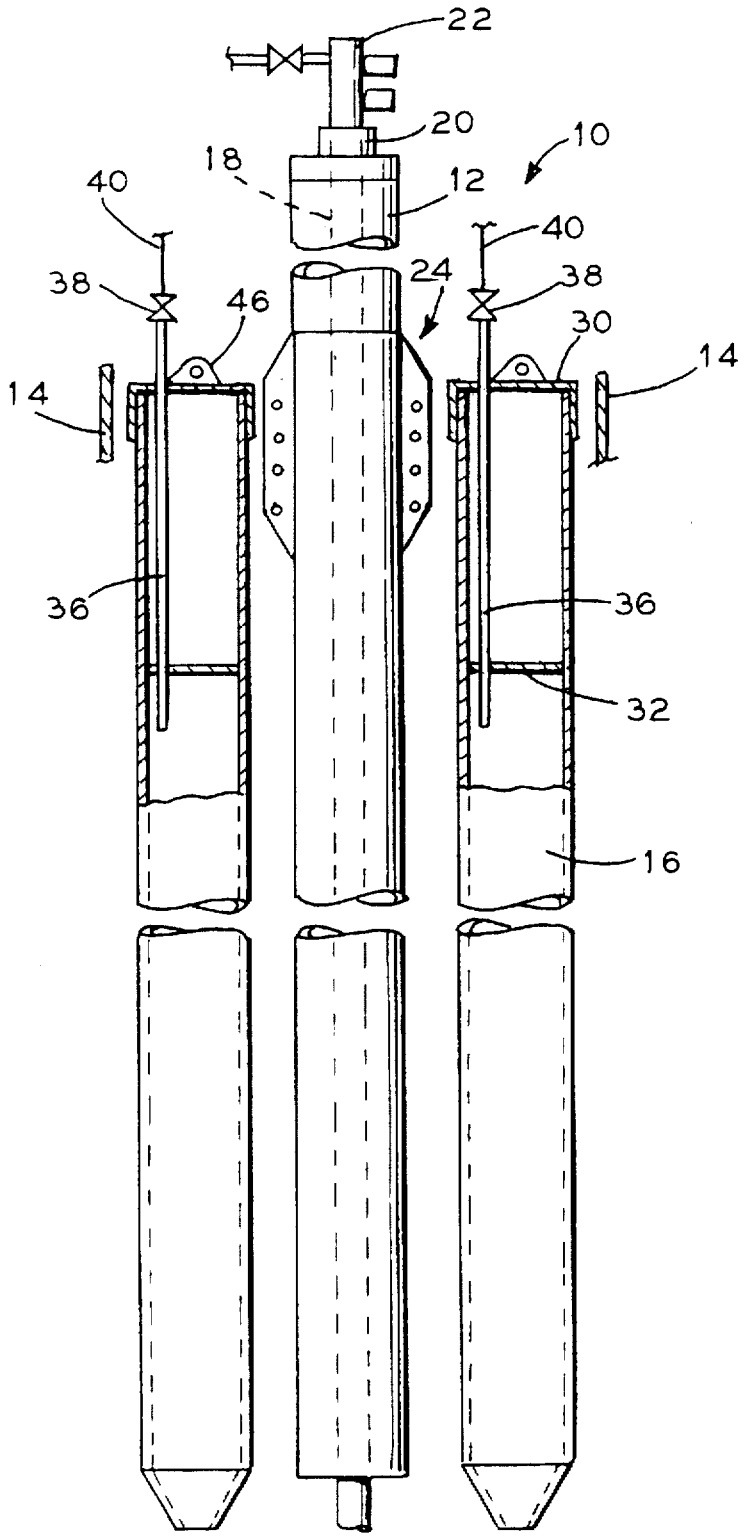
FIG. 1 is an elevation view of the invention.

Referring to the drawings, it is seen in FIG. 1 that the invention is generally indicated by the numeral 10. Riser tensioning device 10 is generally comprised of a stem 12, yoke 13, and variable buoyancy air cans 16.

As seen in FIG. 1, the stem 12 is sized to have an inner diameter which is larger than the outer diameter of the riser 18 such that the stem 12 is readily received around the riser 18. The stem 12 is attached to and packed off at the top of the riser 18, as indicated by numeral 20, such that vertical loads on the stem 12 also act on the riser 18.

Figure 2:
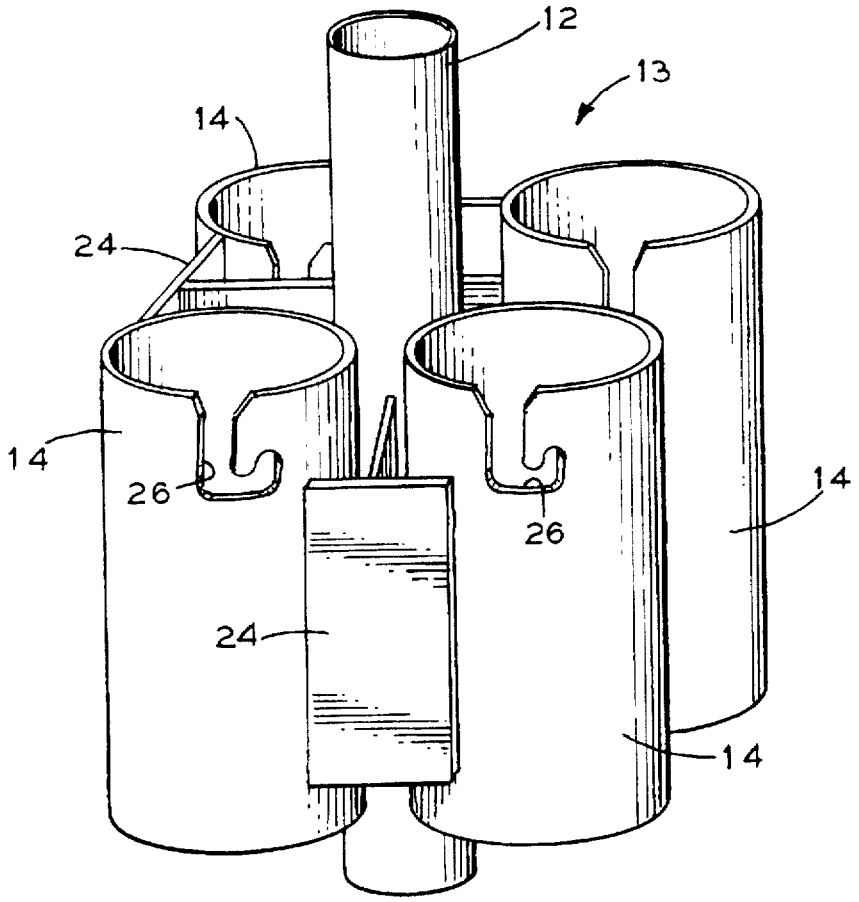
FIG. 2 illustrates the stem and sleeves of the invention.
Figure 3:
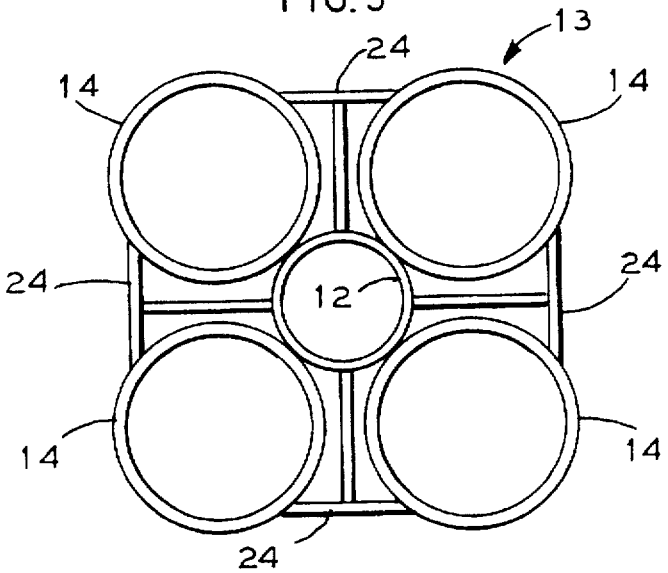
FIG. 3 is a plan view of the stem and sleeves of the invention.

As seen in FIG. 2 and 3, the yoke 13 is formed from sleeves 14 and T-plates 24. The sleeves 14 are rigidly fastened to the stem 12 by means of T-plates 24. The bottom of each T-plate 24 is rigidly attached to the stem 12 by any suitable means such as welding. Each end of the T-plate 24 is rigidly attached to a sleeve 14 by any suitable means such as welding. This forms a yoke which transfers vertical loads from the variable buoyancy air cans 16 to the stem 12. As best seen in FIG. 2, means for retaining the air cans 16 in their respective sleeves 14, while also allowing easy removal, is provided in the form of one or more J-shaped slots 26 in each sleeve 14. Each variable buoyancy air can 16 is provided with corresponding radially extending lugs 28. Any suitable retaining means may be used.

Figure 4:
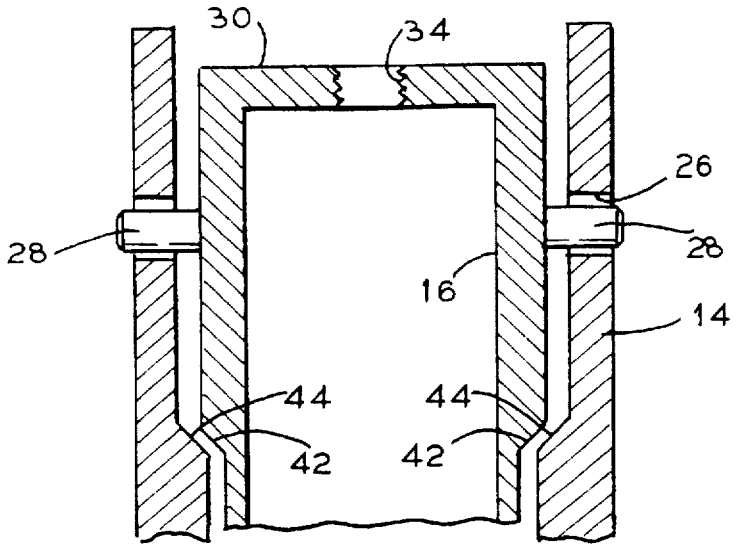
FIG. 4 is a n enlarged detail view that illustrates the air can and sleeve.

The variable buoyancy air cans 16 may be formed from regular steel pipe that is readily available and so do not require special rolling. As seen in FIG. 1 and 4, the upper end of each air can 16 is closed off with a plate 30. At a selected distance down from the top, a second plate 32 is positioned inside the air can 16 to seal a portion of the air can 16 such that the air can has approximately a five percent negative buoyancy when the remaining volume of the air can 16 is completely flooded. This slight negative buoyancy is preferred to have minimum effect on the riser tension if an air can fails. Also, the negative buoyancy is helpful if an air can needs to be changed out. The second plate 32 is preferred but not necessary. The bottom of each air can 16 is open to allow water to flow in and out of the can and may be provided with a tapered bottom to serve as a guide when the can is being lowered through the spar guide frames.

Variable buoyancy control of the air cans 16 is achieved by providing a threaded port 34 in the upper plate 30 of each air can 16. An air delivery pipe 36 is threaded and sealed through both plates 30 and 32 as seen in FIG. 1 such that the air delivery pipe 36 extends below the second plate 32. A suitable valve 38, such as a ball valve, is received at the top of the air delivery pipe 36 and an air line 40 attached to the valve 38 is in communication with a source of compressed air not shown. In this manner, compressed air can be forced into the air cans 16 to increase buoyancy and tension on the riser 18, or air can be bled from the air cans 16 to allow water to enter through the open bottom and reduce buoyancy and tension on the riser 18.

As best seen in FIG. 4, the upper end of each air can 16 may also be provided with an increased outer diameter that extends a selected distance from the top and tapers inwardly to form an angled shoulder 42. Each sleeve 14 is also provided with a corresponding angled shoulder 44. The complementary shoulders allow the air cans 16 to be inserted into the sleeves 14 from the top and prevent the air cans 16 from sliding completely through the sleeves 14 in the event that lugs 28 fail. As seen in FIG. 1, each air can 16 may also be provided with a lifting eye 46 for use during installation and removal of the air cans.

Figure 5:
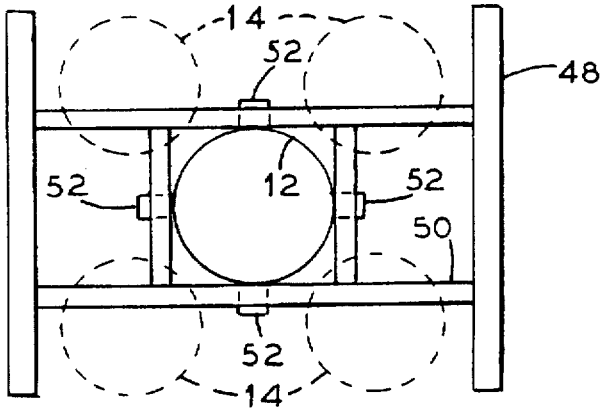
FIG. 5 is a plan view that illustrates the use of a stop frame on the offshore structure.

FIG. 5 is a plan sectional view of a portion of the offshore structure 48 and illustrates a stop frame 50 which is attached to the offshore structure 48 and positioned at a selected level to limit upward movement of the riser tensioning device 10 and riser 18 beyond an acceptable level. This is provided as a safety feature to prevent or minimize damage to the offshore structure in the event that the subsea connection or riser fails, since the excess positive buoyancy from the air cans 16 would cause uncontrolled vertical movement of the riser. Stop plates 52 may be provided as specific contact points. Also, the stop frame 50 may be used in conjunction with a shock absorbing device not shown to absorb the energy of any uncontrolled vertical movement of the riser 18 and riser tensioning device 10.

Figure 6:
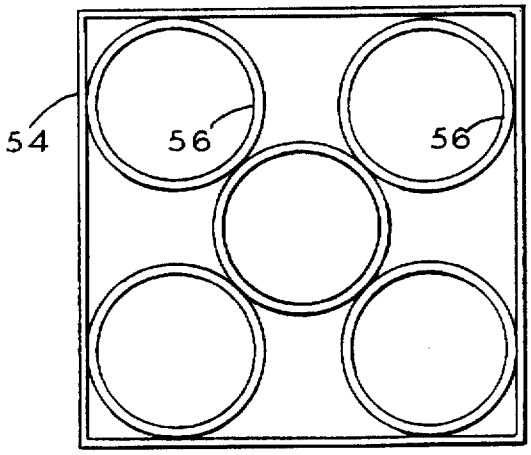
FIG. 6 is a plan view that illustrates the spar buoy structural guide frame for the parallel design air can tensioner.

Since the variable buoyancy air cans 16 may be of a substantial length, one hundred feet or more, one or more guide frames 54, seen in FIG. 6, may be provided and spaced apart at suitable distances along the length of the offshore structure. The guide frame 54 is provided with suitably sized guide sleeves 56 to slidably receive the stem 12 and air cans 16.

In operation, the stem and sleeves are positioned in the offshore structure and the air cans 16 are loaded into the sleeves 14 from the top and locked in the sleeves using the lugs 28 and J-shaped slots 26. In their installed position, the air cans 16 are substantially parallel to each other. This loading may take place during assembly of the offshore structure on shore. The air cans may be tied in place until the offshore structure is installed. Once the offshore structure is installed on site offshore, the riser 18 is run through the stem 12 and attached to the subsea fittings and the wellhead 22. The stem is packed off against the riser 18 and the well head 22 for transfer of vertical loads from the stem 12 to the riser 18. Air is injected into or bled from the air cans 16 to adjust the buoyancy of the air cans 16 and thus maintain the proper tension on the riser 18.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In an offshore structure having drilling and production risers, a riser tensioning device, comprising:

a. a stem received around and attached to a riser such that vertical loads on said stem also act on the riser;

b. a plurality of sleeves attached to said stem and spaced radially around said stem; and c. a variable buoyancy air can received in each sleeve whereby the buoyancy of said air cans acts to place a vertical load on said stem.

2. The riser tensioning device of claim 1, wherein said variable buoyancy air cans are substantially parallel to each other.

3. The riser tensioning device of claim 1, further comprising means for retaining said variable air cans in position in said sleeves.

4. The riser tensioning device of claim 1, wherein each of said variable buoyancy air cans each have a portion of said can sealed to provide a preselected degree of buoyancy when the remaining volume of said air cans is completely flooded.

5. In an offshore structure having drilling and production risers, a riser tensioning device, comprising:

a. a stem received around and attached to a riser such that vertical loads on said stem also act on the riser;

b. a plurality of sleeves attached to said stem and spaced radially around said stem;

c. a variable buoyancy air can received in each sleeve whereby the buoyancy of said air cans acts to place a vertical load on said stem, each of said variable buoyancy air cans having a sealed portion to provide a preselected degree of buoyancy when the remaining volume of said air cans is completely flooded; and d. means for retaining said air cans in position in said sleeves.

6. The riser tensioning device of claim 5, wherein said variable buoyancy air cans are substantially parallel to each other.

* * * * *